United States Patent [19]

Schuller et al.

[11] Patent Number: 4,718,353

[45] Date of Patent: Jan. 12, 1988

[54] CONTAINER CARRYING RAILROAD CAR WITH WALKWAYS FOR ACCESS TO CONTAINERS

[75] Inventors: James J. Schuller, Crete; Harold E. Gramse, Lansing, both of Ill.

[73] Assignee: Thrall Car Manufacturing Co., Chicago, Ill.

[21] Appl. No.: 906,372

[22] Filed: Sep. 12, 1986

[51] Int. Cl.[4] ..... B61D 17/00

[52] U.S. Cl. ..... 105/406.1

[58] Field of Search ..... 105/406.1, 425, 457, 105/460, 355; 410/54

[56] References Cited

U.S. PATENT DOCUMENTS

| | | | |
|---|---|---|---|
| 1,699,529 | 1/1929 | Gibbs et al. | 105/425 X |
| 2,401,401 | 6/1946 | Bartsch | 105/457 |
| 3,357,371 | 12/1967 | Gutridge | 410/54 |
| 4,091,742 | 5/1978 | Cordani | 105/406.1 X |

*Primary Examiner*—Robert B. Reeves
*Assistant Examiner*—Thomas W. Kearns
*Attorney, Agent, or Firm*—Marshall, O'Toole, Murray, Gerstein, & Bicknell

[57] ABSTRACT

A railroad car capable of carrying stacked containers which form stacks of different lengths comprising a car body having opposing car ends supported by rail trucks adapted for movement over a railroad; the car body having opposing side walls and an end wall near each end connected to the side walls with the side walls and end walls defining a well in which a container can be received; supports for the bottom of a container, when in the well; with each side wall including a side top chord member; and walkway boards on top of each side top chord member along each end of the well and accessible from the adjoining car end.

12 Claims, 6 Drawing Figures

CONTAINER CARRYING RAILROAD CAR WITH WALKWAYS FOR ACCESS TO CONTAINERS

This invention relates to railroad cars. More particularly, this invention is concerned with improvements in a railroad car for carrying cargo containers which form stacks of different lengths to provide access for a worker to secure the stacked containers together.

BACKGROUND OF THE INVENTION

Railroad box cars have been in use for many years transporting a wide variety of cargo. Box cars are recognized as being primarily useful when the cargo can be loaded directly in the car from a siding adjacent its production without any prior shipping involving substantial labor in loading and unloading the goods, as from a truck. The same applies at the shipping destination.

In recent years it has been found increasingly efficient to ship cargo in large containers by sea, railroad and highway. Shipping in this manner avoids unpacking the cargo between the time the container is packed by the shipper and received by the customer thereby avoiding extra labor, avoiding breakage and theft in handling and reducing delivery time. These benefits are realized because the containers are sized and shaped to be carried by highway trucks and trailers, special railroad cars and container carrying ships.

One type of railroad car which is particularly suitable for carrying containers is referred to as a well car. Such a car has side and end walls and a partial or full floor thereby defining a well or recessed space into which one or more containers can be longitudinally positioned. The container sides are generally at least two to three times higher than the depth of the well space. Additionally, the containers can be double stacked when desired to increase the shipping load.

Well cars of the described type suitable for carrying containers, and also highway trailers, are disclosed in U.S. Pat. Nos. 4,091,742; 4,400,121; and 4,456,413.

The early well cars had forty feet long wells which were to be filled with one forty, or two twenty, feet long containers. When necessary or desirable the containers were stacked by placing an upper container on top of a lower container in the well.

More recently the length of some containers has increased first to forty-five, and then to forty-eight, feet. Thus, the length of the well has had to be increased to receive the longer containers.

To equally distribute the load in a well car it is necessary to center the containers, regardless of their length, in the well. When a forty foot container is centered in a forty-eight feet well there is a four feet gap at each end between the container and the well end. Similarly, when a forty feet long container is centered in a forty-five feet well the gap is two and one-half feet at each end. Gaps of such distances present a problem in that the laborer must be able to reach the ends of the containers when they are stacked so as to secure the upper container to the lower container. The gaps are too great for most laborers to reach the container ends from the car ends and for those laborers who can reach the containers by extending their reach a potentially unsafe stance is developed which could lead to an accident. There exists, accordingly, a need for an improved well car having means which permits a laborer to readily and safely reach the ends of stacked containers of different lengths in a well car.

SUMMARY OF THE INVENTION

According to the invention there is provided a railroad car capable of carrying stacked containers which form stacks of different lengths comprising a car body having opposing car ends supported by rail truck means adapted for movement over a railroad; the car body having opposing side walls and an end wall near each end connected to the side walls with said side walls and end walls defining a well in which a container can be received; means for supporting the bottom of a container, when in the well; each side wall including a side top chord member; and walkway means on top of each side top chord member along each end of the well and accessible from the adjoining car end.

The walkway means can extend in each longitudinal direction from the end of the well. Also, the walkway means can comprise a substantially flat running board having parallel longitudinal inner and outer side edges parallel with the side wall top chord member.

The inner edge of the running board desirably is spaced horizontally outwardly of the well edge so as not to interfere with loading and unloading containers.

The running board can have an anti-skid surface. However, the running board can be perforated to prevent accumulation of dirt, water, snow and ice. The running board can be spaced a short distance above the top chord upper surface to permit flow of dirt and water there through.

A transverse walkway can be located at each car end and it can extend between the two longitudinal running boards at the car end. A single longitudinal board may be provided extending outwardly from the center of the transverse board to the end of the car to provide access to the end of the adjacent car.

DETAILED DESCRIPTION OF THE DRAWINGS

To the extent it is reasonable and practical the same or similar elements or parts which appear in the various views of the drawings will be identified by the same numbers.

Figure 1:
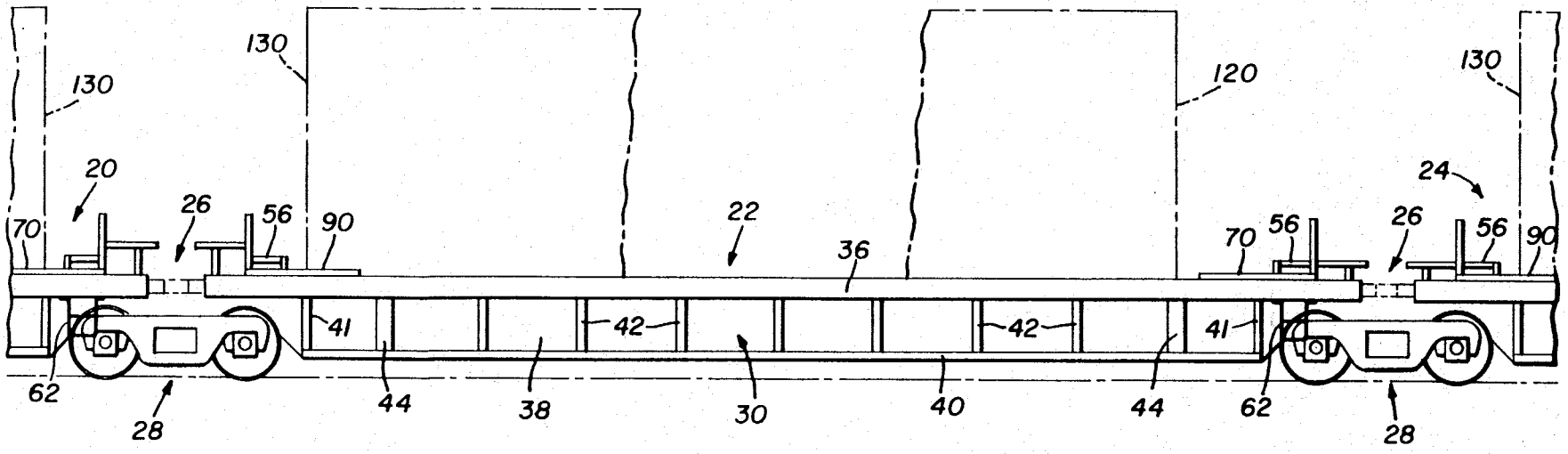
FIG. 1 is a side elevation of a well car according to the invention for carrying containers coupled to similar cars at each end.
Figure 2:
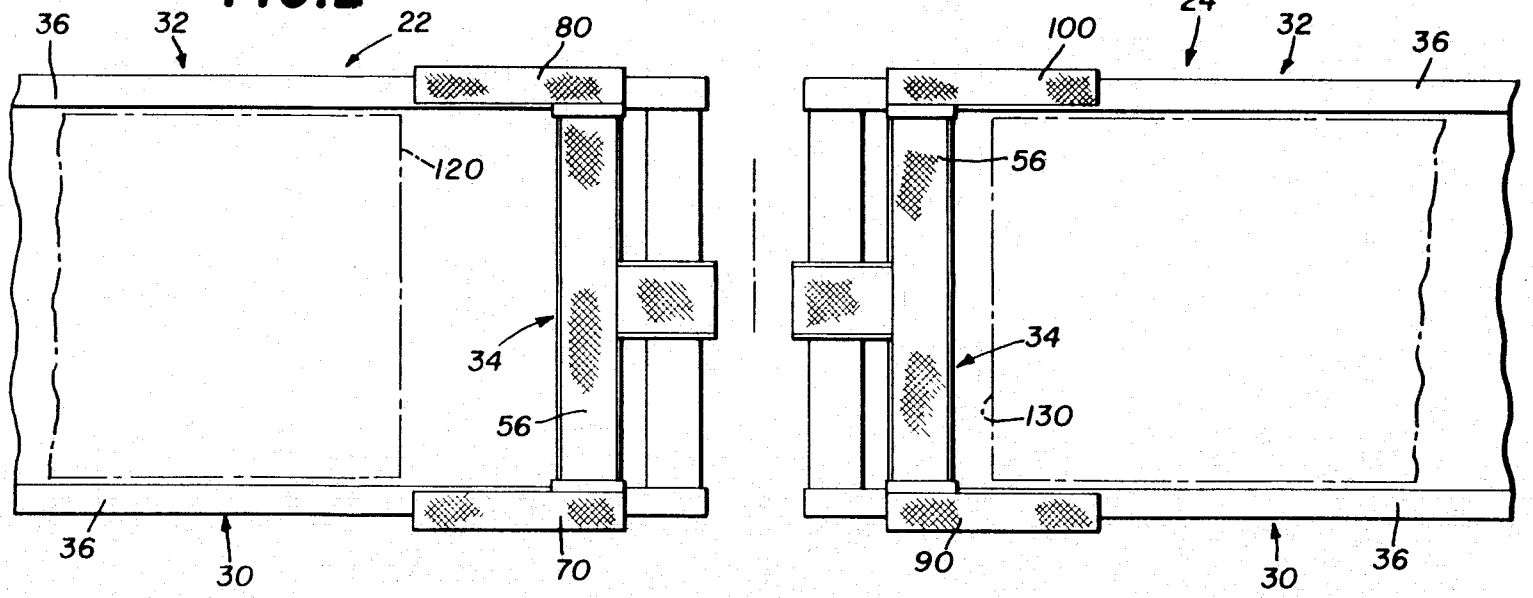
FIG. 2 is a plan view of the ends of two well cars, coupled together as shown in FIG. 1, having walkways on top of the sidewalls at the ends of the well.

With reference to FIG. 1, identical well cars 20,22,24 are coupled together by a commercially avaiable articulated coupler 26 located on the bolster of a standard two axle four wheel railroad truck 28. It is intended that the cars remain coupled together as in a unit train except for repairs and maintenance. It should be understood, however, that each car can have a conventional four wheel truck at each end so that it can be transported independently and be coupled to other types of cars of a train.

Well car 22 has a repair of identical longitudinal spaced apart parallel side walls 30,32 and identical end walls 34 near each end of the car thereby defining a well space in which at least one cargo container can be transported. A well car of this general type is disclosed in U.S. Pat. No. 4,456,413.

Each side wall 30,32 has a top chord member in the form of a tube 36 at the top. They function as major load bearing members. Additionally, each side wall 30,32 comprises a metal sheet or plate 38 extending from tube 36 downwardly and having a longitudinal horizontal angle member 40 at the bottom. The angle members 40 also function as load bearing members. Vertical corner posts 41 are located at the corners of each side wall 30,32. A series of spaced apart vertical side wall braces 42 extend from each tube 36 to angle member 40 and are joined to plate 38. Near each end of each side wall 30,32 is located a stronger vertical side brace 44 which extends from tube 36 to near the lower edge of sheet 38. One or more lateral cross braces not shown are positioned in spaced apart arrangement and joined at their ends to the angles 40 to provide an open grid floor in the well.

The end of each car has an end sill 50 which extends to each of the side wall chords 36. Shear plate 52 is supported on and joined to end sill 50 and the side wall chords 36. The shear plate 52 extends to the well end wall 34.

A transverse walkway in the form of a running board 56 extends across the width of the car adjacent each end of the well. The running board 56 is supported above shear plate 52 by supports 58 and 60.

Figure 3:
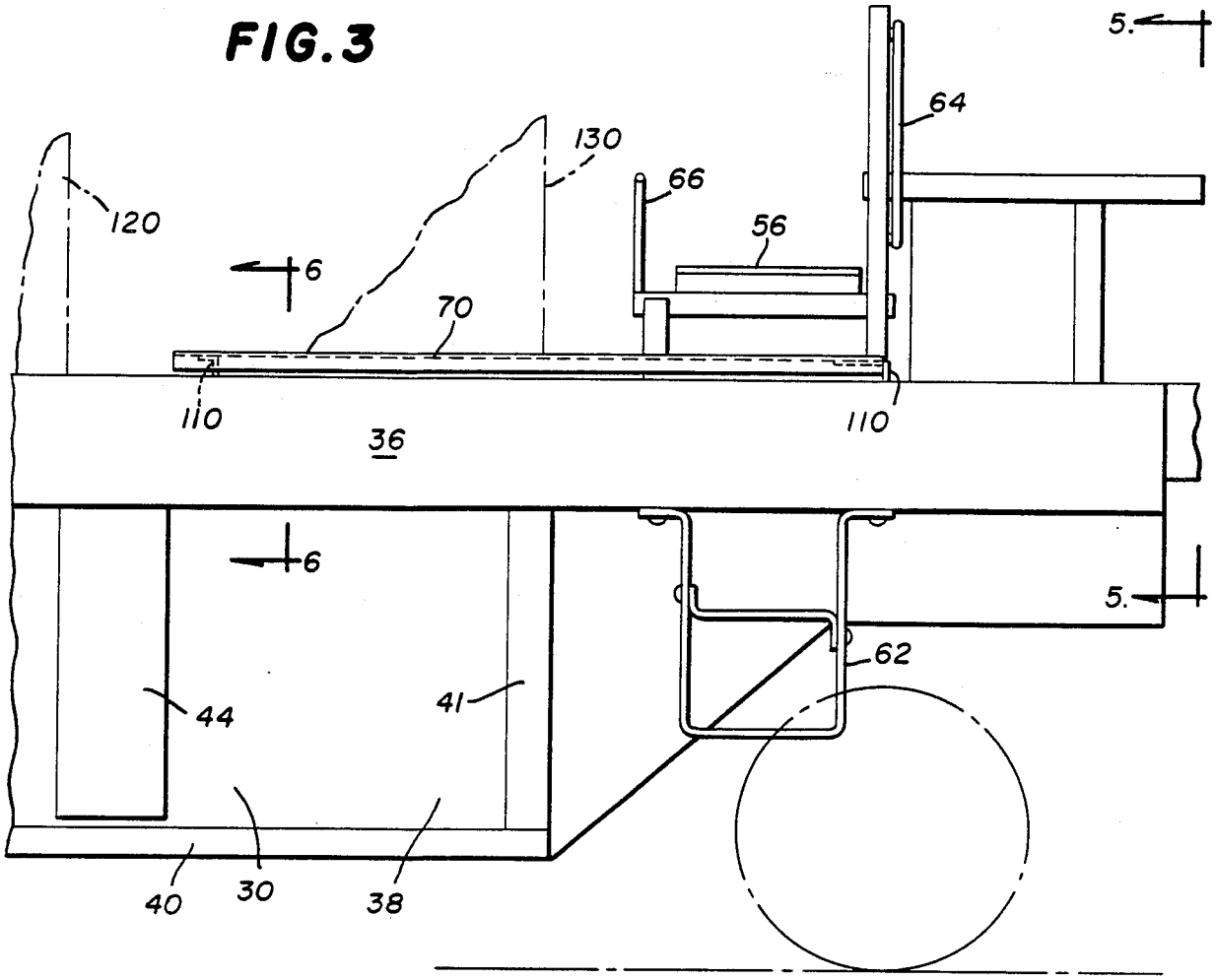
FIG. 3 is a side elevational view of the end of the well car shown in FIG. 1.
Figure 4:
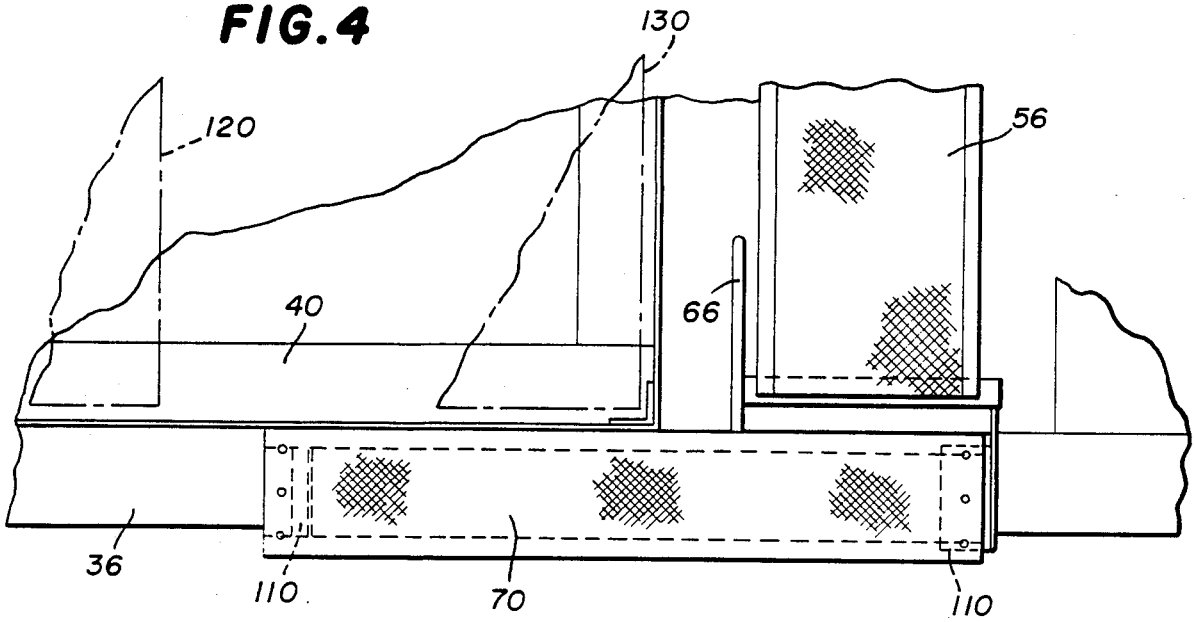
FIG. 4 is a partial plan view of one end of a well car showing a walkway on top of the side wall.
Figure 5:
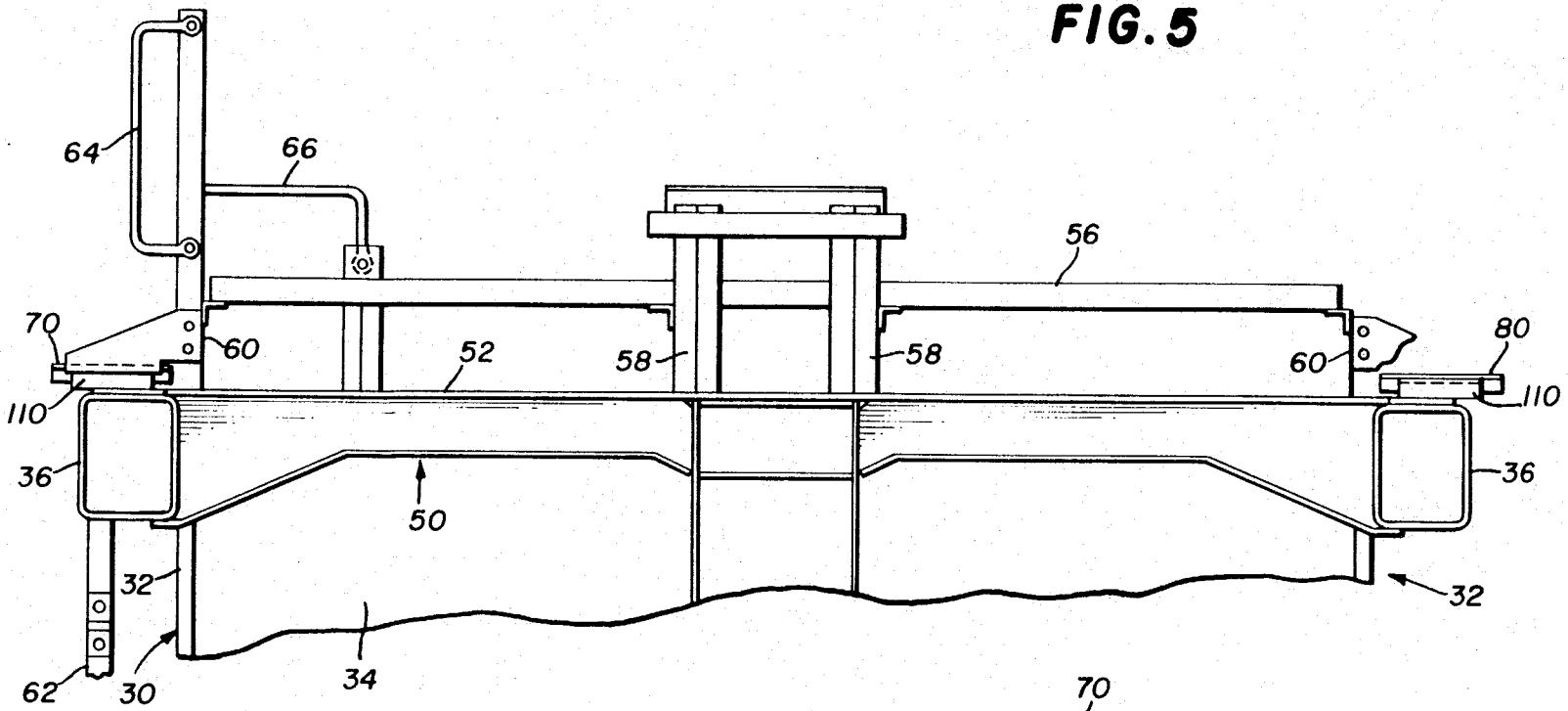
FIG. 5 is a sectional view taken along the line 5—5 of FIG. 3.
Figure 6:
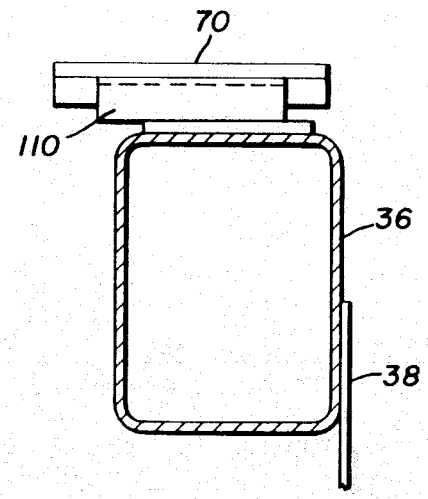
FIG. 6 is a sectional view taken along the line 6—6 of FIG. 3.

A sill step 62 is mounted on side wall tube or chord 36 on diagonally opposite corners of the car adjacent the ends of transverse running boards 56 (FIG. 3). Hand rails 64,66 are also provided on the upper part of the car ends for a laborer or worker to grip when he ascends or decends the sill step 62.

Separate identical walkways in the form of running boards 70, 80, 90, 100 are mounted on top of top chord or tube 36 by means of angle member supports 110. These running boards extend longitudinally in both directions from the end of the well. Thus, the running boards 70, 80, 90, 100 extend across the transverse running boards 56 so that a worker can step from one to the other. Additionally, each running board 70, 80, 90, 100 extends towards the center of the car a sufficient distance to permit a worker to walk thereon to the ends of short containers stacked in the well. FIGS. 1 to 4 show short 120 and long 130 stacked containers in phantom positioned in the cars. Because of the present length of the containers it is generally desirable to have the running boards 70, 80, 90, 100 about four to six feet long.

The longitudinal inner edge of each running board 70, 80, 90, 100 is positioned outward from the edge of the well so that it does not obstruct the movement of containers in and out of the well. Also, to obtain adequate width for walking, the outer edge of these running boards can extend outwardly of the side wall edge a short distance.

Each running board 70, 80, 90, 100 can be made of a solid metal plate with an anti-skid surface. Desirably, each of these running boards is made of a perforated metal sheet so that dirt, water, snow and ice cannot accumulate thereon and cause a worker to slip. To permit flow of dirt and water through the running boards the boards can be mounted a short distance above the tube 36.

The foregoing detailed description has been given for clearness of understanding only, and no unnecessary limitations should be understood therefrom, as modifications will be obvious to those skilled in the art.

What is claimed is:

1. A railroad car capable of carrying stacked containers which form stacks of different lengths comprising:
   - a car body having opposing car ends supported by rail truck means adapted for movement over a railroad;
   - the car body having opposing side walls and an end wall near each end connected to the side walls with said side walls and end walls defining a well in which a container can be received;
   - means for supporting the bottom of a container, when in the well;
   - each side wall including a side top chord member;
   - walkway means in fixed non-movable position on top of each side top chord member along each end of the well and accessible from the adjoining car end;
   - the walkway means extending in each longitudinal direction form the longitudinal end of the well;
   - the walkway means comprising a substantially flat running board having parallel longitudinal inner and outer side edges parallel with the side wall top chord;
   - the inner edge of the running board being spaced horizontally outwardly of the well longitudinal edge; and
   - a transverse walkway means located adjacent but past each well end and extending to the two running boards at the car sides.

2. A railroad car according to claim 1 in which the running board is about four to six feet long.

3. A railroad car according to claim 1 in which the running board has an anti-skid surface.

4. A railroad car according to claim 1 in which the car nas sill step access means along the side adjacent to diagonally opposite running boards.

5. A railroad car according to claim 1 in which the running board is perforated to prevent accumulation thereon of dirt, water, snow and ice.

6. A railroad car according to claim 5 in which the top chord has an upper surface and the running board is spaced a short distance above the top chord upper surface.

7. A railroad car capable of carrying stacked containers which form stacks of different lengths comprising:
   - a car body having opposing car ends supported by rail truck means adapted for movement over a railroad;
   - the car body having opposing side walls and an end wall near each end connected to the side walls with said side walls and end walls defining a well in which a container can be received;
   - means for supporting the bottom of a container, when in the well;
   - each side wall including a side top chord member;
   - walkway means in fixed non-movable position on top of each side top chord member along each end of the well and accessible from the adjoining car end;
   - the walkway means comprising a substantially flat running board having parallel longitudinal inner and outer side edges parallel with the side wall top chord;

the inner edge of the running board being spaced horizontally outwardly of the well longitudinal edge; and a transverse walkway means located adjacent but past each well end and extending to the two running boards at the car sides.

8. A railroad car according to claim 7 in which the running board is about four to six feet long.

9. A railroad car according to claim 7 in which the running board has an anti-skid surface.

10. A railroad car according to claim 7 in which the car has still step access means along the side adjacent to diagonally opposite running boards.

11. A railroad car according to claim 7 in which the running board is perforated to prevent accumulation thereon of dirt, water, snow and ice.

12. A railroad car accoridng to claim 11 in which the top chord has an upper surface and the running board is spaced a short distance above the top chord upper surface.

* * * * *

UNITED STATES PATENT AND TRADEMARK OFFICE

CERTIFICATE OF CORRECTION

PATENT NO. : 4,718,353

DATED : January 12, 1988

INVENTOR(S) : James J. Schuller et al

It is certified that error appears in the above-identified patent and that said Letters Patent is hereby corrected as shown below:

Column 2, line 63, change "avaiable" to -- available --; column 3, line 3, change "repair" to -- pair --; column 4, line 24, change "form" to -- from --; line 41, change "nas" to -- has --.

Signed and Sealed this

Nineteenth Day of July, 1988

*Attest:*

DONALD J. QUIGG

*Attesting Officer*

*Commissioner of Patents and Trademarks*